United States Patent [19]

Choi

[11] 4,248,462

[45] Feb. 3, 1981

[54] BINDING AND SEALING STRIP

[75] Inventor: Gwang H. Choi, Seoul, Rep. of Korea

[73] Assignee: Ben Clements & Sons, Inc., South Hackensack, N.J.

[21] Appl. No.: 4,955

[22] Filed: Jan. 19, 1979

[30] Foreign Application Priority Data

May 12, 1978 [KR] Rep. of Korea ..... 2549

[51] Int. Cl.[3] ..... B65D 33/34

[52] U.S. Cl. ..... 292/322

[58] Field of Search ..... 292/316–322; 24/16 PB

[56] References Cited

U.S. PATENT DOCUMENTS

| | | | |
|---|---|---|---|
| 3,118,200 | 1/1964 | Bell | 24/16 PB |
| 3,339,246 | 9/1967 | Geisinger | 24/16 PB |
| 3,672,003 | 6/1972 | Morgan | 24/16 PB |
| 3,708,835 | 1/1973 | Bienz | 24/16 PB |
| 3,860,997 | 1/1975 | Van Riper, Jr. et al. | 24/16 PB |
| 3,954,294 | 5/1976 | Iwamoto et al. | 292/318 |

*Primary Examiner*—Richard E. Moore

*Attorney, Agent, or Firm*—Blum, Kaplan, Friedman, Silberman & Beran

[57] ABSTRACT

A binding and sealing strip comprises a cord with locking members at the ends thereof such that when one is inserted in the other they cannot be separated. The strip is preferably of flexible plastic and can be molded to be small enough in size so that it can be threaded into the mesh of a burlap bag, for instance, for binding and sealing the open end of same.

5 Claims, 3 Drawing Figures

BINDING AND SEALING STRIP

BACKGROUND OF THE INVENTION

The present invention relates to the field of devices for binding and sealing various types of packages in a way such that the package cannot be opened without destroying the integrity of the device. This field actually dates back to the use of sealing wax into which an impression is made with a unique object such as a signet ring.

Sealing devices now find wide use to prevent theft where the thief plans to remove a portion of the contents of a package and to reclose same, hoping to avoid detection. Sealing devices which cannot be opened and resealed are useful in preventing such theft, much of which is carried out by employees of the organization which prepares the packages.

While there have been available binding strips useful for such objectives as tying the ends of bags and tying together articles of clothing so that they cannot be separated from each other without destroying the tie device, such devices have generally required special equipment to put them in place. The present invention is designed to meet the need for a binding and sealing strip which requires no auxiliary equipment, which is light in weight, small in size and, especially, low in cost.

SUMMARY OF THE INVENTION

A binding and sealing strip in accordance with the present invention comprises a flexible cord at one end of which is an arrow-headed latch member and at the other end of which is a locking frame. Preferably, the entire strip including the latch member and the locking frame are of a flexible plastic which can be molded.

The latch member has the form of an arrow-head with a triangular notch behind same. The locking frame has a mouth for receiving the arrow-head. At the mouth is a wedge-shaped element the root of which is attached to the frame and which biases the wedge into the mouth. The position of the wedge in standby condition is such that insertion of the arrow-head of the latch member displaces the wedge outwardly until the arrow-head portion of the latch member passes the wedge. At this point the root biases the wedge into the notch so that the wedge lodges against the base of the arrow-head to prevent retraction thereof. Preferably the direction of the notch is such that a corner is formed at the base of the arrow-head. Accordingly, any attempt to retract the arrow-head part of the latch member tends to indent the wedge, thereby providing further security against removal of the wedge from the notch.

Accordingly, an object of the present invention is a binding and sealing strip which is low in weight, small in size and low in cost.

A further object of the present invention is a binding and sealing strip which can be manufactured by molding and having locking members at the ends thereof such that once joined, they cannot be separated without destroying the device.

Another object of the present invention is a binding and sealing strip wherein a wedge seats into a notch to prevent separation of the two ends of said strip once they are joined.

An important object of the present invention is a binding and sealing strip which is sufficiently small in size so that it can be threaded through the mesh of a burlap bag for sealing same or tying such bags together or tying an object to said bag.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
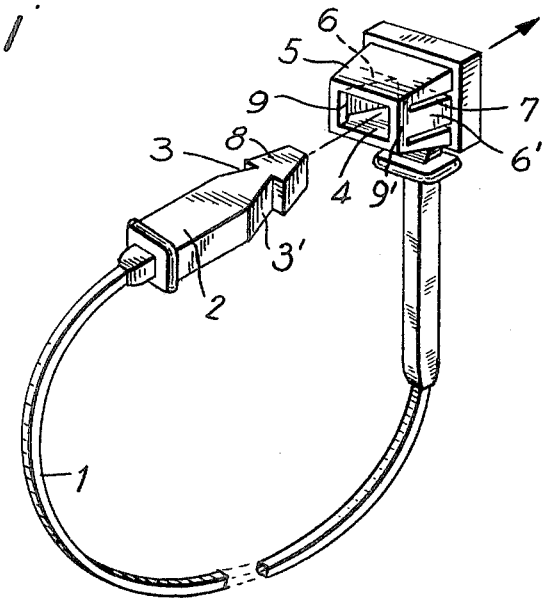
FIG. 1 is a perspective view of an embodiment of the invention prior to locking the ends thereof together.

A binding and sealing strip in accordance with the present invention is shown in FIG. 1, said device comprising a flexible cord 1, a latch member 2 and a locking frame 5. Preferably the cord 1, the latch member 2 and the locking frame 5 are molded integrally of a flexible plastic. As is evident, the length of cord 1 is a matter of choice as is also the cross-section thereof. However, a convenient length for the cord itself is about 4 inches, the overall length of the strip then being between 5 and 6 inches. Preferably, the maximum dimension of the cross-section of the latch member should not exceed $\frac{1}{8}$ inch to make it possible to thread said latch member through cloth of coarse weave, a typical cloth being burlap. Obviously, it is only necessary for one of the two ends of the cord to be fitted with a latch element which is small enough to be threaded through a bag, but it is desirable that the other member also be as small as possible in the interest of minimizing the quantity of plastic in the device and thus minimizing the cost thereof.

Latch member 2 has a forward portion 8 shaped like an arrow-head. To the rear of arrow-head portion 8 are triangular notches 3 and 3', the purpose of which will become evident.

Figure 2:
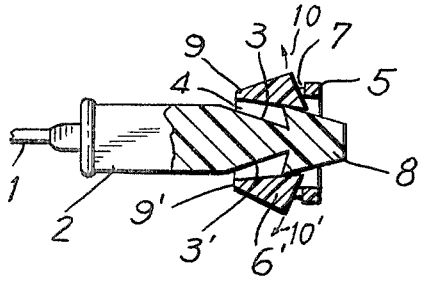
FIG. 2 is a partial sectional view of the embodiment of FIG. 1 with one end of said device partially inserted into the other end thereof.

Locking frame 5 has a mouth 4 of a size for receiving latch member 2 with clearance. On either side of mouth 4 are wedges 6 and 6' separated from the remainder of locking frame 5 by slots 7. Wedges 6 and 6' are attached to frame 5 by roots 9 and 9', said roots holding said wedges in a position such that the clearance therebetween is too small to allow insertion of arrow-head part 8 without spreading said wedges apart, as the result of which said roots 9 and 9' bias said wedges inwardly of said mouth as they are spread apart by arrow-head 8 during insertion of said latch member 2 into said locking frame. This condition is clearly shown in FIG. 2 in which the side faces of arrow-head part 8 have spread wedges 6 and 6' in the directions indicated by arrows 10 and 10'.

Figure 3:
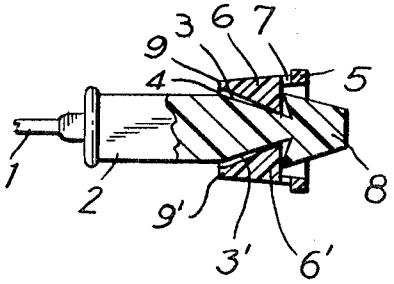
FIG. 3 is a partial sectional view of the embodiment of FIG. 1 with the ends thereof locked together.

The next stage of the operation of joining latch member 2 to locking frame 5 is shown in FIG. 3 in which arrow-head part 8 has been inserted into locking frame 5 to a depth at which said arrow-head part 8 has passed wedges 6 and 6'. Once released from the spreading action of arrow-head part 8, wedges 6 and 6' move toward each other under the biasing of roots 9 and 9', entering triangular notches 3 and 3', respectively. Retraction of latch member 2 from locking frame 5 then becomes impossible since the attempt to move latch member 2 rearwardly cannot generate any force component tending to move wedges 6 and 6' apart. Moreover, as can be seen from FIGS. 2 and 3, triangular notches 3 and 3' are undercut so that they penetrate slightly into arrow-head part 8. The result is that when the two members are placed in tension, the base of arrow-head part 8 tends to indent (not shown) wedges 6 and 6', thereby providing further security against dislodgement of said wedges from said notches.

By appropriate selection of the synthetic resin of which said strip is molded, substantial strength and resistance to corrosion can be provided, those skilled in the art being well aware of appropriate materials. Further, cord 1 can be made strong enough so that it is extremely difficult to break same without the use of tools. The device is sufficiently small so that it can be packaged readily in an extremely small space and the quantity of material necessary for the manufacture thereof is so small that the material cost is extremely low.

As is evident, the number of wedges and notches necessary for conferring the locking characteristic and other operating features of the present invention is not limited to two. A latch member which has a tapered end and only one notch on the side thereof would also function satisfactorily. Similarly, a latch member of generally cylindrical shape with a conical tip and having an annular groove behind the tapered portion would also operate in the same manner, the number of wedges ranging from 1 upwardly.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A lockable and unreleasable binding and sealing strip, comprising a flexible cord;

a latch member at one end of and integral with said cord, said latch member having a head part having side faces in the shape of an arrowhead and having a pair of triangular notches forming acute-angled corners with said side faces;

a locking frame at the other end of and integral with said cord, said frame being essentially tubular and having a pair of opposing side walls and a mouth for reception of said head part with minimal clearance, each of said side walls having a U-shaped slot therein forming an element the exterior of which is normally essentially coplanar with said wall and having a flexible root biasing said element inwardly of said mouth, said element being shaped in section perpendicular to said side wall for lodging in one of said notches and being disposed relative to said mouth so that said element is initially displaced outwardly of said side wall by rotation around said root on insertion of said latch member into said mouth and is moved inwardly by said biasing root into engagement with said notch as said head part passes said element, said notch of said arrowhead lying within said essentially tubular frame when engaged with said element for preventing disengagement of said element from said notch, said notch being so shaped that attempt to retract said latch member from said frame produces no outward force against said element, whereby said latch member is locked unreleasably into said frame by lodgement of said element in said notch.

2. The lockable binding and sealing strip, as defined in claim 1, wherein said cord, latch member and said locking frame are of molded flexible plastic.

3. A lockable binding and sealing strip, comprising a flexible cord;

a latch member at one end of and integral with said cord, said latch member having a head part having side faces in the shape of an arrowhead and having a pair of triangular notches forming acute-angled corners with said side faces;

a locking frame at the other end of and integral with said cord, said frame being essentially tubular and having a pair of opposing side walls and a mouth for reception of said head part, each of said side walls having a U-shaped slot therein forming an element having a flexible root biasing said element inwardly of said mouth, said element being shaped in section perpendicular to said side wall for lodging in one of said notches and being disposed relative to said mouth so that said element is initially displaced outwardly of said side wall by rotation around said root on insertion of said latch member into said mouth and is moved inwardly by said biasing root into said notch as said head part passes said element, said notch being so shaped that attempt to retract said latch member from said frame produces no outward force against said element, whereby said latch member is locked unreleasably into said frame by lodgement of said element in said notch, wherein said corners are so disposed that an attempt to retract said latch member from said locking frame would tend to indent said element, thereby providing further security against freeing said element from said notch in said latch member.

4. The lockable binding and sealing strip, as defined in claim 1, wherein said flexible cord and latch member are small enough in transverse section so that at least said latch member and cord can be inserted between the strings of a burlap bag for tying shut the open end thereof and for tying another object to said bag.

5. The lockable binding and sealing strip, as defined in claim 1, wherein the maximum transverse dimension of said latch member and cord is $\frac{1}{8}$ inch.

* * * * *